US011549371B2

(12) United States Patent
Bourhila et al.

(10) Patent No.: US 11,549,371 B2
(45) Date of Patent: Jan. 10, 2023

(54) METHOD FOR PICKLING A TURBOMACHINE COMPONENT

(71) Applicant: SAFRAN AIRCRAFT ENGINES, Paris (FR)

(72) Inventors: Noureddine Bourhila, Moissy-Cramayel (FR); Laurent Besnault, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/293,691

(22) PCT Filed: Nov. 14, 2019

(86) PCT No.: PCT/FR2019/052707
§ 371 (c)(1),
(2) Date: May 13, 2021

(87) PCT Pub. No.: WO2020/099794
PCT Pub. Date: May 22, 2020

(65) Prior Publication Data

US 2021/0404340 A1 Dec. 30, 2021

(30) Foreign Application Priority Data

Nov. 14, 2018 (FR) ..... 1871525

(51) Int. Cl.
*F01D 5/00* (2006.01)
*C23G 5/00* (2006.01)

(52) U.S. Cl.
CPC ..... *F01D 5/005* (2013.01); *C23G 5/00* (2013.01); *F05D 2230/80* (2013.01)

(58) Field of Classification Search
CPC ..... F01D 5/005; F01D 25/002; C23G 5/00; F05D 2230/80; C23F 1/12
See application file for complete search history.

(56) References Cited

U.S. PATENT DOCUMENTS 4,698,130 A * 10/1987 Restall ..... C23G 5/00 216/75
6,066,241 A * 5/2000 Pierre ..... C23G 5/00 156/345.46
6,328,810 B1 * 12/2001 Conner ..... C23G 5/00 134/4

(Continued)

FOREIGN PATENT DOCUMENTS

EP 0 239 307 A1 1/1987
EP 2 762 612 A1 8/2014

*Primary Examiner* — Ryan J. Walters
(74) *Attorney, Agent, or Firm* — Birch, Stewart, Kolasch & Birch, LLP

(57) ABSTRACT

The invention relates to a method for pickling a turbomachine component (1), comprising the following steps: positioning the component in a closed chamber (2), injecting a gas mixture (3) into the chamber (2), the gas mixture (3) comprising a halogenated gas, heating the chamber (2), the method being characterised in that: the gas mixture further comprises dihydrogen, the heating step is carried out at a temperature higher than 1000° C. and the step of injecting the gas mixture (3) is carried out by circulating through the chamber (2) a flow of gas mixture (3) having a flow rate between 6 and 15 times the volume of the chamber (2) per hour.

11 Claims, 1 Drawing Sheet

(56) References Cited

U.S. PATENT DOCUMENTS

2010/0218787 A1* 9/2010 Ladru ..... C23G 5/00
134/2
2011/0005549 A1* 1/2011 Pillhofer ..... F01D 25/002
134/3

* cited by examiner

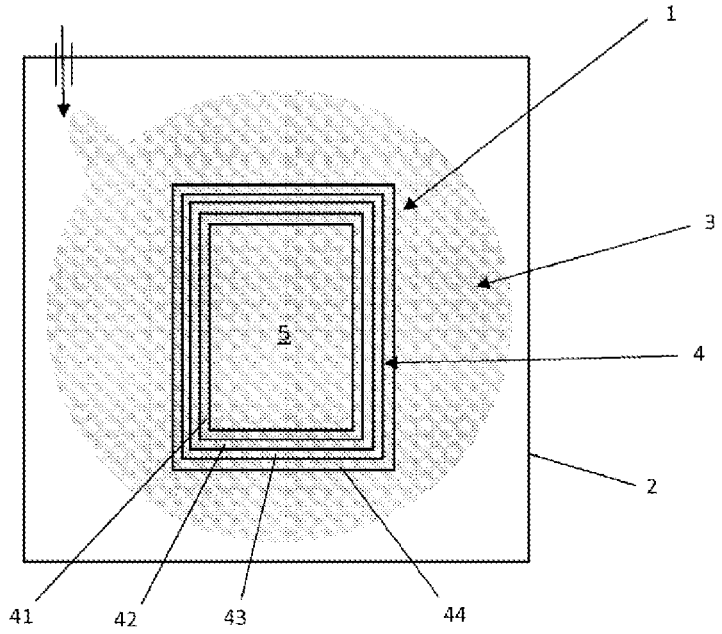
1
3
5
4
2
41
42
43
44

METHOD FOR PICKLING A TURBOMACHINE COMPONENT

GENERAL TECHNICAL FIELD AND PRIOR ART

The invention relates to the general field of surface treatment processes, and more particularly to processes for surface pickling turbomachine components.

A turbomachine conventionally has at least one flow path through which an air stream flows and is compressed by one or more compressors before entering a combustion chamber where the air is mixed with a fuel and then ignited.

The burnt gas mixture then drives one or more turbines in rotation which drive the compressor(s) in rotation, the gas flow being then ejected.

Turbine components, exposed to very high temperatures, are generally treated or coated with refractory materials or alloys in order to limit their degradation.

For example, it is known to coat such components with one or more layers of aluminum alloys, so-called aluminides, for example titanium aluminides, and/or one or more layers of oxides, for example molybdenum oxides, or ceramics, forming a thermal barrier on the surface of the component.

When it is necessary to repair such components, coating pickling operations are necessary to rehabilitate the base material composing the component, called substrate.

These pickling steps typically comprise several steps:

- at least one sandblasting or chemical bath step in order to remove the thermal barrier,
- at least one chemical bath step in order to remove the aluminide coatings,
- at least one additional step of sandblasting the component at the exit of the chemical bath in order to remove the remaining residues.

However, these operations do not eliminate oxides or contaminants embedded in cracks or defects on the surfaces of the components.

In order to clean these cracks from possible oxides or corrosion, an additional step during which a thermochemical operation is performed on the component, conventionally in a high-temperature furnace and under fluorinated atmosphere (conventionally called fluoride-ion cleaning, or FIC).

However, such operations are a source of risk for the components due to the potential danger of chemical attack of the substrate material by the chemicals used.

Sandblasting operations, which are mechanical abrasion operations, naturally attack the substrate.

Moreover, the quest for weight savings to minimize the overall weight of turbomachines leads to turbomachine components with increasingly thin walls, which limits the margin of substrate consumption during such pickling processes.

The succession of these operations also generates a difficulty in the quality of the treatment. Indeed, if a step is not carried out perfectly and leaves unpickled areas, the following treatment operations will also be degraded and the component can then be rendered unusable, because the reiteration of the process in order to eliminate the remaining coating areas would attack the substrate too deeply.

On the other hand, the chemical baths used contain substances or components that are dangerous for the operators, such as hydrofluoric acids conventionally used in aluminum pickling baths.

GENERAL PRESENTATION OF THE INVENTION

One purpose of the invention is to simplify the process of pickling the surfaces of turbomachine components.

Another purpose of the invention is to reduce the risk of substrate degradation during the process of pickling turbomachine components.

Another purpose of the invention is to limit the use of products that are dangerous for the operators.

To this end, the invention proposes a process for pickling a turbomachine component, comprising the following steps:

- Positioning the component in a closed chamber,
- Injecting a gas mixture into the chamber, the gas mixture comprising a halogenated gas,
- Heating the chamber, the process being characterized in that:

- the gas mixture further comprises dihydrogen,
- the heating step is carried out at a temperature greater than 1000° C. and
- the step of injecting the gas mixture is carried out by circulating through the chamber a flow of gas mixture having a flow rate comprised between 6 and 15 times the volume of the chamber per hour.

Such a process makes it possible in particular to remove in one thermochemical treatment phase the layers of the aluminide-based coating and the layers of the metal oxide-based coating, which makes it possible to pickle the component and reveal the substrate without requiring a chemical bath or sandblasting step to remove this type of layer.

The pickling process is therefore simplified and made safer, as the substrate is not degraded during the process and the operators are not brought into contact with dangerous products.

Such a process is advantageously completed by the following features, taken alone or in combination:

- the gas mixture contains fluorine; a halogenated element allowing a higher reaction rate than when other halogenated elements are used;
- the temperature of the heating step is greater than 1030° C.; this increases the efficiency of the pickling and cleaning process, in particular by increasing the reaction kinetics;
- the gas mixture also contains an inert gas, for example argon; this transports the reactive gases and contributes to the homogenization of the gas mixture in the furnace chamber;
- a concentration of the halogenated gas in the gas mixture is comprised between 4% and 12% by mass, preferentially between 6% and 8% by mass; this controls the amount of the reactive gas introduced into the chamber and thus controls the reaction on the surface of the components, in particular by controlling the rate of diffusion of the species;
- the flow rate of the flow of gas mixture is comprised between 8 and 12 times the volume of the chamber per hour; this provides the necessary and sufficient amount of active gas to carry out an effective reaction on all the components in the chamber;
- a total pressure in the chamber is substantially equal to atmospheric pressure;
- a total pressure in the chamber is lower than atmospheric pressure; this saves time, requires less gas and is more efficient because the gases can penetrate more quickly and very efficiently into cracks, fissures and cavities;

the process consists of a succession of steps of:

- Sandblasting the component (1),

Positioning the sandblasted component (1) in the closed chamber (2),

Injecting the gas mixture (3) into the chamber (2) and

Heating the chamber (2).

PRESENTATION OF THE FIGURES

FIG. 1 is a schematic representation showing the implementation of a process for pickling a component according to the invention.

Other features and advantages of the invention will emerge from the following description, which is purely illustrative and non-limiting, and should be read in conjunction with the single appended FIGURE, which is a schematic diagram representing a device for implementing a process for pickling a component according to the invention.

DESCRIPTION OF ONE OR MORE EMBODIMENTS

The invention relates to a process for pickling a turbomachine component 1, characterized in that it comprises the following steps:

Positioning the component 1 in a closed chamber 2,

Injecting a gas mixture 3 into the chamber 2, the gas mixture 3 comprising at least one halogenated gas, Heating the chamber 2, The process being characterized in that:

the gas mixture further comprises dihydrogen, the heating step is carried out at a temperature greater than 1000° C., and the step of injecting the gas mixture 3 is carried out by circulating through the chamber 2 a flow of gas mixture having a flow rate comprised between 6 and 15 times the volume of the chamber 2 per hour.

The invention advantageously applies to a component 1 having a coating 4 comprising at least one aluminide layer 41 comprising one or more aluminide species, or at least one oxide layer 42 comprising one or more metal oxide species, or a combination of such layers.

During this process, the halogenated gas(es) react with the aluminide layers 41 and the oxide layers 42 according to the following reactions:

For aluminide species: $HX(g)+ScAl(s)\rightarrow AlX3(g)+H2+Sc(s)$

For oxide species: $HX(g)+MxOy(s)\rightarrow MxX\ (g)+H2O(g)$

With X a halogen species, H hydrogen, M a metal, O oxygen, Al aluminum, Sc a transition metal.

For example, X can be fluorine, chlorine, bromine or iodine and Sc can be nickel, cobalt, titanium or any other transition metal.

Preferentially, the halogen species X comprises fluorine, for example in the form of hydrofluoric acid. Fluorine has a high reactivity and allows a faster reaction than with the use of other halogenated elements.

It is understood that this type of reaction is an illustrative example, and the process can be applied to any aluminide or modified aluminide compound, not just nickel aluminide.

Particular mention may be made of nickel aluminides, modified platinum aluminides, cobalt aluminides, titanium aluminides, etc.

The layers of the aluminide-based coating 41 and the layers of the metal oxide-based coating 42 are therefore removed in a thermochemical treatment phase, which allows the component 1 to be pickled and the substrate 5 to be exposed without requiring a chemical bath or sandblasting step to remove this type of layer.

The pickling process is therefore simplified and made safer, as the substrate is not degraded during the process and the operators are not brought into contact with dangerous products.

The chamber 2 is continuously traversed by a flow of gas mixture 3 which has a flow rate representing between 6 and 15 times the volume of the chamber 2 per hour, preferentially between 8 and 12 times the volume of the chamber 2 per hour.

This provides the necessary and sufficient amount of active gas to operate an effective reaction on the totality of the component in the chamber (in terms of volume or surface).

The flow rate of the gas mixture 3 can be adapted as a function of the quantity of components 1 to be treated, or the total surface to be stripped.

By way of example, the flow rate of halogenated gas can be comprised between 6 L/min and 10 L/min, and the flow rate of dihydrogen can be comprised between 130 L/min and 160 L/min for a chamber with a volume of the order of 1 m3 in which 45 components 1 are placed.

The heating phase comprises a temperature increase, a temperature holding stage and a cooling.

The temperature holding stage can last between 2 hours and 10 hours, preferentially between 3.5 hours and 5.5 hours (i.e., 3 hours and 30 minutes or 5 hours and 30 minutes).

The temperature of the holding stage is greater than 1000° C., preferably greater than 1030° C., for example comprised between 1035° C. and 1055° C.

Such temperature intervals have the effect of increasing the efficiency of the pickling and cleaning process compared with a simple cleaning of the oxides, as it is the case in standard FIC processes. Indeed, the kinetics of the reactions involved, either with the oxides or with the NiAl or NiAlPt alloys of the coating to be pickled, is a function of the temperature.

Advantageously, a sandblasting step can be performed prior to the thermochemical treatment. This makes it possible to remove combustion residues, for example scale, formed on the surface of the coating 4 during the operation of the turbomachine, as well as any ceramic thermal barrier layers 43 and the passivating layers 44 covering them, for example layers comprising calcium-magnesium-aluminosilicate.

The sandblasting step thus exposes the aluminide layers 41 and the oxide layers 42 of the coating, which will be removed in a thermochemical cycle phase.

The upstream sandblasting step is therefore not dangerous for the substrate 5.

After the preliminary blasting, one or more components 1 are placed in a closed chamber 2, preferentially on a grid, allowing a better circulation of the gas mixture 3 along the entire surface of the component(s) 1, which improves the treatment.

The gas mixture 3 is then injected into the chamber 2.

Optionally, the gas mixture 3 further comprises a component or a combination of components from the following components:

hydrofluoric acid HF, hydrochloric acid HCl, hydrobromic acid HBr, hydroiodic acid HI.

The gas mixture 3 can also advantageously include dihydrogen.

Optionally but advantageously, the gas mixture 3 further comprises an inert gas, for example helium, neon, argon, krypton, xenon or radon, or a combination thereof.

This allows the reactive gases to be transported and contributes to the homogenization of the gas mixture 3 in the furnace chamber 2.

The concentration of halogenated gas in the gas mixture 3 is advantageously comprised between 4% and 12%, preferentially between 6% and 8%, for example in percentages by mass.

This controls the amount of reactive gas introduced in the chamber and optimizes the reaction on the surface of the components.

This optimizes the process in order to avoid that the reactions become too slow if the concentrations are low, or on the contrary to avoid that high concentrations lead to a saturation of the atmosphere which would be detrimental to the efficiency of the reactions and would lead to a risk of contamination of the base material (fluorine, chlorine, etc.).

The concentration of halogenated gases has in particular an influence on the diffusion rate of the reactive species, with the temperature.

Optionally, the supply of the gas mixture 3 to the chamber 2 follows a sequential cycle, and has:

an injection phase, during which the gas mixture 3 is injected into the chamber 2, a treatment phase during which the gas mixture 3 is maintained in the chamber 2 during heating so as to react with the coating 4, and a purging phase during which the treatment reagents are evacuated with the gas mixture 3 contained in the chamber 2.

After the purge phase, a new injection phase is carried out and a feed cycle is started again until the thermochemical treatment is completed.

The thermochemical treatment can be carried out at atmospheric pressure, or preferentially under reduced pressure (or low pressure, i.e., below 300 mbar). Treatment under reduced pressure saves time, requires less gas and is more efficient because the gases can penetrate cracks, fissures and cavities more quickly and very effectively, even if they are too narrow and deep.

The invention claimed is:

1. A process for pickling a turbomachine component, the process comprising the following steps:

positioning the component in a closed chamber;

injecting a gas mixture into the chamber, the gas mixture comprising a halogenated gas and dihydrogen gas, the step of injecting the gas mixture being carried out by circulating through the chamber a flow of gas mixture having a flow rate comprised between 6 and 15 times a volume of the chamber per hour, and heating the chamber at a temperature greater than 1000° C.

2. The pickling process as claimed in claim 1, wherein the gas mixture comprises fluorine.

3. The pickling process as claimed in claim 1, wherein the temperature of the heating step is greater than 1030° C.

4. The pickling process as claimed in claim 1, wherein the gas mixture further comprises an inert gas.

5. The pickling process as claimed in claim 1, wherein a concentration of the halogenated gas in the gas mixture is comprised between 4% and 12% by mass.

6. The pickling process as claimed in claim 1, wherein the flow rate of the flow of gas mixture is comprised between 8 and 12 times the volume of the chamber per hour.

7. The pickling process as claimed in claim 1, wherein a total pressure in the chamber is substantially equal to atmospheric pressure.

8. The pickling process as claimed in claim 1, wherein a total pressure in the chamber is lower than atmospheric pressure.

9. The pickling process as claimed in claim 1, wherein the gas mixture further comprises argon.

10. The pickling process as claimed in claim 1, wherein a concentration of the halogenated gas in the gas mixture is comprised between 6% and 8% by mass.

11. A process for pickling a turbomachine component, the process comprising only the following steps:

sandblasting the component;

positioning the sandblasted component in a closed chamber;

injecting a gas mixture into the chamber, the gas mixture comprising a halogenated gas and dihydrogen gas, the step of injecting the gas mixture being carried out by circulating through the chamber a flow of gas mixture having a flow rate comprised between 6 and 15 times a volume of the chamber per hour, and heating the chamber at a temperature greater than 1000° C.

* * * * *